US011396758B2

(12) United States Patent
Cappelle

(10) Patent No.: US 11,396,758 B2
(45) Date of Patent: Jul. 26, 2022

(54) PANEL

(71) Applicant: Flooring Industries Limited, SARL, Bertrange (LU)

(72) Inventor: Mark Cappelle, Staden (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 17/236,381

(22) Filed: Apr. 21, 2021

(65) Prior Publication Data

US 2021/0324634 A1 Oct. 21, 2021

(30) Foreign Application Priority Data

Apr. 21, 2020 (BE) ..... 2020/5266

(51) Int. Cl.
*E04F 15/02* (2006.01)
*E04F 15/10* (2006.01)

(52) U.S. Cl.
CPC ..... *E04F 15/02038* (2013.01); *E04F 15/102* (2013.01); *E04F 15/107* (2013.01); *E04F 2201/0138* (2013.01); *E04F 2201/0146* (2013.01); *E04F 2201/0511* (2013.01); *E04F 2201/0535* (2013.01); *E04F 2201/0552* (2013.01); *E04F 2201/0588* (2013.01)

(58) Field of Classification Search
CPC ..... E04F 15/02038; E04F 2201/0138; E04F 2201/0511; E04F 15/102; E04F 15/107; E04F 2201/0146; E04F 2201/0535; E04F 2201/0552; E04F 2201/0588
USPC ..... 52/582.1, 582.2, 586.1, 585.1
See application file for complete search history.

(56) References Cited

U.S. PATENT DOCUMENTS 6,647,690 B1 11/2003 Martensson
6,675,545 B2 * 1/2004 Chen ..... B29C 48/11 52/309.1
6,769,835 B2 8/2004 Stridsman
6,854,235 B2 2/2005 Martensson
7,451,578 B2 11/2008 Hannig
7,603,826 B1 10/2009 Moebus
(Continued)

FOREIGN PATENT DOCUMENTS

CA 991373 A 6/1976
DE 20008708 U1 9/2000
(Continued)

OTHER PUBLICATIONS

Belgian Search Report, from corresponding BE application No. 202005266, dated Dec. 17, 2020.

*Primary Examiner* — Brent W Herring
(74) *Attorney, Agent, or Firm* — Workman Nydegger

(57) ABSTRACT

Panel comprising a horizontally and a vertically active locking system, so that two such floor panels can be connected by means of a downward movement. The vertically active locking system comprises a locking element formed by an insert, formed by a coextruded strip. This comprises a blocking body, a securing section and a bending zone. The blocking body is substantially made of a first polymer; the bending zone is substantially made of a second polymer. The blocking body is substantially or entirely made of a mixture of the first polymer and the second polymer, or the bending zone is substantially or entirely made of a mixture of the second polymer and the first polymer.

17 Claims, 8 Drawing Sheets

(56) References Cited

U.S. PATENT DOCUMENTS

| | | | | |
|---|---|---|---|---|
| 7,621,092 | B2 | 11/2009 | Groeke et al. | |
| 7,980,043 | B2 | 7/2011 | Moebus | |
| 8,024,904 | B2 | 9/2011 | Hannig | |
| 8,132,384 | B2 | 3/2012 | Hannig | |
| 8,429,870 | B2 * | 4/2013 | Chen | E04F 15/02 52/592.1 |
| 8,631,621 | B2 | 1/2014 | Hannig | |
| 8,635,829 | B2 * | 1/2014 | Schulte | E04F 13/08 52/582.1 |
| 8,966,853 | B2 | 3/2015 | Hannig | |
| 9,556,620 | B2 * | 1/2017 | Cappelle | E04F 15/10 |
| 9,695,600 | B2 * | 7/2017 | Vandevoorde | B32B 29/06 |
| 10,047,529 | B2 * | 8/2018 | Vandevoorde | B32B 15/14 |
| 10,100,531 | B2 * | 10/2018 | Devos | E04F 15/10 |
| 2003/0180091 | A1 | 9/2003 | Stridsman | |
| 2004/0068954 | A1 | 4/2004 | Martensson | |
| 2004/0211143 | A1 | 10/2004 | Hanning | |
| 2007/0193178 | A1 | 8/2007 | Groeke et al. | |
| 2008/0010938 | A1 | 1/2008 | Hannig | |
| 2009/0249733 | A1 | 10/2009 | Moebus | |
| 2011/0088346 | A1 | 4/2011 | Hannig | |
| 2011/0131916 | A1 * | 6/2011 | Chen | E04F 15/02 52/582.1 |
| 2012/0011796 | A1 | 1/2012 | Hannig | |
| 2014/0150369 | A1 | 6/2014 | Hannig | |
| 2014/0242342 | A1 * | 8/2014 | Vandevoorde | B32B 29/005 428/192 |
| 2014/0366475 | A1 * | 12/2014 | Cappelle | E04F 15/02 52/582.1 |
| 2015/0047284 | A1 * | 2/2015 | Cappelle | E04F 15/02 52/311.1 |
| 2015/0337542 | A1 * | 11/2015 | Cappelle | E04F 15/02038 52/309.1 |
| 2016/0115695 | A1 * | 4/2016 | Devos | E04F 15/02038 52/582.2 |
| 2017/0254095 | A1 * | 9/2017 | Vandevoorde | E04F 15/06 |

FOREIGN PATENT DOCUMENTS

| | | | | |
|---|---|---|---|---|
| DE | 20112474 | U1 | 12/2002 | |
| DE | 29924454 | U1 | 5/2003 | |
| DE | 102004055951 | A1 | 7/2005 | |
| DE | 102004001363 | A1 | 8/2005 | |
| DE | 102005002297 | A1 | 8/2005 | |
| DE | 202007000310 | U1 | 4/2007 | |
| EP | 1159497 | A1 | 12/2001 | |
| EP | 1282752 | A1 | 2/2003 | |
| EP | 1350904 | A2 | 10/2003 | |
| EP | 1415056 | B1 | 1/2006 | |
| EP | 1818478 | A1 | 8/2007 | |
| EP | 3004487 | B1 * | 10/2019 | E04F 15/02038 |
| ES | 2755163 | T3 * | 4/2020 | E04F 15/02038 |
| JP | H07300979 | A | 11/1995 | |
| SE | 515324 | C2 | 7/2001 | |
| WO | 2004079130 | A1 | 9/2004 | |
| WO | 2005054599 | A1 | 6/2005 | |
| WO | 2006043893 | A1 | 4/2006 | |
| WO | 2006104436 | A1 | 10/2006 | |
| WO | 2007008139 | A1 | 1/2007 | |
| WO | 2007015669 | A2 | 2/2007 | |
| WO | 2007079845 | A1 | 7/2007 | |
| WO | 2009066153 | A2 | 5/2009 | |
| WO | 2010082171 | A2 | 7/2010 | |
| WO | 2014191861 | A1 | 12/2014 | |
| WO | WO-2014191861 | A1 * | 12/2014 | E04F 15/02038 |

* cited by examiner

PANEL

BACKGROUND

The present invention relates to a panel, such as for example a floor panel, a ceiling panel, a wall panel or the like.

SUMMARY

More particularly, it relates to a panel which comprises coupling parts on at least two opposite sides in the form of a male coupling part and a female coupling part, respectively, which allow two such panels to be connected to each other on the aforementioned sides, or in other words to be brought to a coupled position by fitting one of these panels with the associated male coupling part into the female coupling part of the other floor panel by means of a downward movement, in such a way that at least a locking in a horizontal direction is achieved in this case.

Couplings which allow two panels, such as floor panels, to be coupled to each other by joining together one floor panel with the other by a downward movement, are divided into two kinds in practice, namely a first kind in which the coupling parts only provide a horizontal locking without there being a locking in a vertical direction, and a second kind in which both a horizontal and a vertical locking are provided.

The couplings of the first kind are also known as so-called "drop-in" systems. Floor panels which are provided therewith on two opposite sides are known, inter alia, from CA 991 373 and JP 07-300 979. As these patent documents show, such "drop-in" systems are often used on only a first pair of opposite sides of the floor panels, whereas coupling parts are then used on the second pair of opposite sides which, in the coupled position of two floor panels, provide both a vertical and a horizontal locking and which allow coupling of two such floor panels to each other by means of a rotating movement. Floor panels comprising such a combination of coupling parts have the advantage that they can easily be installed in successive rows, simply by coupling every new floor panel to be laid to the previous row of floor panels by means of the rotating movement and by ensuring that such a floor panel simultaneously also engages with a preceding floor panel which has already been laid in the same row when rotating it down. The installation of such a floor panel therefore only requires a rotating and laying movement, which is a particularly user-friendly laying technique.

A drawback of floor panels comprising such coupling parts is that due to the fact that there is no locking in a vertical direction, differences in height between the coupled floor panels may occur on the upper surface. Thus, for example, such floor panels in a first or last row of a floor covering may rotate back upwards from their flat position if they are not held down by a skirting board or the like. Even if such floor panels are provided with a "drop-in" system on only one pair of sides, while they are locked on their other pair of sides with respect to adjacent floor panels in both a horizontal and vertical direction, differences in height between adjacent floor panels may occur on the sides which are coupled to the "drop-in" system, inter alia if two adjacent floor panels are subjected to different loads or if one floor panel were to become slightly warped and bent with respect to the other.

Couplings of the aforementioned second kind, also referred to as "push lock" systems, try to overcome the aforementioned drawback by also providing a vertical locking. Such so-called "push lock" systems can be divided into two different categories, namely single-part embodiments and embodiments which contain a separate locking element which is designed as an insert which is secured to the actual floor panel, optionally in a fixed manner.

Single-part embodiments are known, inter alia, from the patent documents DE 299 24 454, DE 200 08 708, DE 201 12 474, DE 10 2004 001 363, DE 10 2004 055 951, EP 1 282 752 and EP 1 350 904. The known single-part embodiments have the drawback that they are relatively stiff and it cannot always be guaranteed that two floor panels will be reliably joined together.

Embodiments which comprise a separate locking element, which helps to achieve a vertical and, if desired, also horizontal locking between two coupled floor panels are known, inter alia, from the patent documents DE 20 2007 000 310, DE 10 2004 001 363, DE 10 2005 002 297, EP 1 159 497, EP 1 415 056 B1, EP 1 818 478, WO 2004/079130, WO 2005/054599, WO 2006/043893, WO 2006/104436, WO 2007/008139, WO 2007/079845, WO 2009/066153, WO 2010/082171 and SE 515324. The use of a separate locking element offers the advantage that the material thereof is independent from the actual floor panel and may thus be chosen to be optimal based on the use. In this way, such inserts may be made of plastic or metal, as a result of which relatively strong yet easily movable locking portions can be achieved which are able to absorb relatively large forces using a minimal contact surface.

The present invention relates to panels or floor panels which are provided with a "push lock" system of the latter category, in other words which contain an optionally fixedly attached, but separately produced insert. The object of the invention is to achieve a further optimization of these "push lock" systems in floor panels.

The invention relates to panels and in particular to floor panels which are of the specific type:

which comprises coupling parts on at least two opposite sides by means of which coupling parts two such panels or floor panels can be coupled to each other;

wherein these coupling parts form a horizontally active locking system and a vertically active locking system;

wherein the horizontally active locking system has a male part and a female part which allow two such floor panels to be connected to each other on said sides by fitting one of these floor panels with the associated male part in the female part of the other floor panel by means of a downward movement;

wherein the vertically active locking system comprises a locking element which is fitted in one of the respective sides in the form of an insert.

Floor panels of this type are known, inter alia, from FIGS. 5-7, 8 and 9-11 of the aforementioned EP 1 415 056 B1. In these known embodiments, the locking portion designed in the form of an insert consists of a plastic strip with a lip which can be elastically bent and which functions as a rotatable blocking body while it is being bent. These known embodiments have the advantage that by means of a relatively simple construction, a so-called "push-lock" connection can be achieved which is active along the entire length of the plastic strip. However, it has been found in practice that this known embodiment does not always work easily.

Meanwhile, WO 2009/066153 and WO 2010/082171 have disclosed locking elements which, in addition to a rotatable blocking body, also comprise a securing section, for example in the form of a clamped part, wherein this securing section retains the strip in the recess, and furthermore also comprise a bending zone made of a material which differs from the material of the blocking body. The insert known from the aforementioned documents is substantially made of PVC (polyvinyl chloride). Although the locking elements disclosed there offer a compromise between vertical locking strength, by means of the stiff blocking body, and a smooth coupling movement, by means of the bending zone which is specially provided for this purpose, such a strip may cause problems during coupling itself. The strips known from the aforementioned documents have the drawback that the blocking body may be pushed out of its desired position in a vertical direction during coupling and/or that the panels may become damaged during coupling, in particular when the insert is situated on that side of the panel which is provided with the male part. In such a case, the insert may, during the downward coupling movement, come into contact with the decorative surface on the edge which is provided with the female part. In the case of relatively brittle surface layers, such as laminate layers based on melamine formaldehyde, urea-formaldehyde or phenol formaldehyde or with varnish layers or lacquer layers, for example as finishes in the case of wooden top layers, undesirable crumbling or splintering of the respective layer may occur.

WO 2006/043893 and WO 2007/015669 disclose locking elements, wherein these locking elements are designed as an insert having a block-shaped cross section, which is provided in one of the sides in a so-called displacement groove, and wherein this locking element can be bent in the horizontal plane so that it moves twice in the aforementioned displacement groove. The inserts disclosed in these documents may be made, for example, from polypropylene. There is a risk of the bendable insert becoming blocked in the displacement groove.

The present invention firstly aims to provide alternative panels of the aforementioned specific type which, according to various preferred embodiments thereof, are improved further with respect to the aforementioned known embodiments, wherein these improvements make it possible, for example, to achieve an easier and more reliable coupling of two such panels.

To this end, the invention relates to a panel which comprises coupling parts on at least two opposite sides, by means of which coupling parts two such panels can be brought into a coupled position; wherein these coupling parts form a horizontally active locking system and a vertically active locking system; wherein the horizontally active locking system has a male part and a female part which allow two such panels to be connected to each other at the aforementioned sides by fitting one of these panels with the associated male part in the female part of the other panel by means of a downward movement. The vertically active locking system comprises a locking element which is fitted in one of the respective sides in the form of an insert. This locking element comprises at least a blocking body, a securing section and a bending zone. The aforementioned bending zone consists of an elastic bending zone which forms a connection between the securing section and the blocking body. The locking element consists of a strip which is secured in a recess in the panel. The locking element consists of a co-extruded plastic strip which, viewed in cross section, consists of several zones made of plastic with different properties, namely, on the one hand, at least a first zone formed by the aforementioned blocking body, and, on the other hand, at least a second zone formed by the aforementioned bending zone. The blocking body is substantially made of a first polymer. The bending zone is substantially made of a second polymer. The panel is characterized by the fact that the blocking body is substantially or entirely made of a mixture of the first polymer and the second polymer, or by the fact that the bending zone is substantially or entirely made of a mixture of the second polymer and the first polymer.

By using a mixture of the first polymer and the second polymer, a good connection between the blocking body and the bending zone is produced, without the risk of the connection between the blocking body and the bending zone breaking or becoming damaged. As a result thereof, a more reliable coupling between the panels is achieved and the coupling can be made more reliable.

The expression "substantially made of the first or second polymer" is preferably understood to mean that this first or second polymer is at least 50% by weight, and more preferably at least 60% by weight and even more preferably at least 70% by weight of the respective product.

In a preferred embodiment, the blocking body is substantially or entirely made of the first polymer and the bending zone is substantially or entirely made of a mixture of the second polymer and the first polymer.

Preferably, in the bending zone, the percentage by weight of the first polymer in the mixture of the second polymer and the first polymer is more than 1% by weight, more preferably more than 5% by weight, more preferably more than 10% by weight, and more preferably more than 15% by weight. Preferably, this percentage by weight is less than 30% by weight.

For example, the blocking body may consist of ABS (acrylonitrile butadiene styrene); and the bending zone consists of a mixture of 20% by weight of acrylonitrile butadiene styrene and 80% by weight of thermoplastic polyurethane (TPU).

In a preferred embodiment, the bending zone is substantially or entirely made of the second polymer and the blocking body is substantially or entirely made of a mixture of the first polymer and the second polymer.

Preferably, in the blocking body, the percentage by weight of the second polymer in the mixture of the first polymer and the second polymer is more than 1% by weight, more preferably more than 5% by weight, more preferably more than 10% by weight, and more preferably more than 15% by weight. Preferably, this percentage by weight is less than 30% by weight.

For example, the bending zone may consist of thermoplastic polyurethane (TPU); and the blocking body consists of a mixture of 80% by weight of ABS (acrylonitrile butadiene styrene) and 20% by weight of thermoplastic polyurethane (TPU).

Preferably, the aforementioned blocking body at one end forms a stop-forming locking portion which can cooperate with a locking portion of a similar coupled panel.

Preferably, the first polymer is acrylonitrile butadiene styrene (ABS). A blocking body which substantially or entirely made of ABS has an oil-like surface, as a result of which the friction of the blocking body with the other parts of the panel may be reduced. In particular, it is possible to extrude ABS having a smooth surface, for example without noticeable flow lines on the extruded surface. This makes it possible to produce an easier and more reliable coupling without damage.

Preferably, the second polymer is a polyurethane or a polyurethane-based plastic, for example polyisocyanurate. This offers the advantage that a very pliable and bendable bending zone is obtained.

Preferably, the securing section is made of the same polymer or polymer mixture as the blocking body. This facilitates the coextrusion of the plastic strip.

It will be clear that the strip may be designed to have a blocking body with a substantially block-shaped cross section or a blocking body with a lip which can be bent elastically, or more particularly with a rotatable blocking body. Preferably, the locking element comprises a securing section which retains the strip in the recess. According to a first possibility, the securing section may in this case consist of a section which extends in a continuous or more or less continuous way along the respective side and in the aforementioned recess or, according to a second possibility, consists of one or more local sections distributed along the respective side, wherein these local sections retain the strip in one or more locations in the recess.

Preferably, the aforementioned bending zone relates to an elastic bending zone which forms a connection, preferably the only connection, between the possible securing section and the blocking body. It is preferably also the only connection between the possible securing section and the blocking body if the aforementioned bending zone is less elastic or not elastic.

According to a particular embodiment, the aforementioned bending zone has both a first boundary surface with the aforementioned blocking body and a second boundary surface with the aforementioned securing section, wherein the aforementioned blocking body and the securing section, in the non-coupled position, extend, at least along a part, vertically one under the other in a horizontal direction, wherein points of both the first and the second boundary surface are situated above one another on a vertical line and wherein the aforementioned first boundary surface, in the aforementioned non-coupled position of the panels, broadly extends in a direction which encloses an angle of less than 45° with the upper surface of the panels.

In the context of the present invention, the expression "non-coupled position" is understood to mean a position in which the insert is arranged in the recess, but in which the respective panel, on the side with the insert, is not coupled to another such panel and is not in any stage of an initiated coupling movement.

According to the abovementioned particular embodiment, this achieves that, in the non-coupled position, sections of the blocking body and the securing section are engaged under each other or are hooked under each other. Due to the position of the respective boundary surfaces, namely a position in which they at least comprise points on a vertical line above one another, the risk of shearing occurring in the bending zone is limited. Preferably, the respective boundary surfaces extend at least for a third, and better still for half of the smallest boundary surface, under one another. A further limitation of such shearing is achieved by the first boundary surface broadly enclosing a limited angle with the horizontal. Preferably, this angle is smaller than 30° or even smaller than 20°. The combination of these measures results in a limitation of the degree to which the blocking body can be pushed out of its desired position during the downward coupling movement.

Due to the fact that the aforementioned measures or, in other words, the features of the abovementioned particular embodiment, are at least present in the non-coupled position, the invention renders the coupling easier, at least at the start of the downward coupling movement. The combination of the aforementioned measures, namely that the aforementioned blocking body and the securing section extend, at least along a part, vertically one under the other in a horizontal direction, wherein points of both the first and the second boundary surface are situated above one another on a vertical line and wherein the first boundary surface broadly extends in a direction which encloses an angle with the horizontal of less than 45°, or better less than 30° or less than 20°, is preferably also present in a position in which the aforementioned blocking body is situated entirely under the top side of that panel in which it is secured and/or in the coupled position of two such panels. It goes without saying that such preferred embodiments further facilitate the ease with which the coupling movement is executed. It will be clear that the position in which the aforementioned blocking body is situated entirely under the top side of that panel in which it is secured in this case is an end position which can be reached during the coupling movement or at least a nearby position. Also in one or more of these positions, it is preferred if the respective boundary surfaces extend, at least for a third, and better still for half or more of the smallest boundary surface, vertically one under the other in a horizontal direction.

As mentioned above, the blocking body preferably relates to a rotatable blocking body. However, it is not ruled out that the blocking body may be a strip which is movably arranged in the aforementioned recess. It may be, for example, a strip which, viewed in cross section, can be displaced in a plane, either a horizontal plane or in another plane at right angles to the aforementioned cross section, for example in a plane which makes an angle of 0 to 50 degrees to the horizontal plane. The displacement as such may be the result of a bending of the respective strip in this plane. With a strip which is movably arranged in the recess, the ABS material achieves a significant reduction in the risk of the blocking body becoming blocked in the recess during the downward coupling movement. During the downward coupling movement, the blocking body has to be moved in the recess and towards the end of the coupling movement, such a blocking body has to move back automatically in the direction of the starting position in order to make contact with the locking portion of the other panel to be coupled thereto.

Preferably, the aforementioned locking element is fitted as an insert in a recess in the aforementioned male part. In the case of a rotatable blocking body, its stop-forming locking portion is preferably directed upwards. In such a case, this blocking body, in the non-coupled position, preferably furthermore has a surface which comes into contact with the top edge of the other panel during the aforementioned downward movement, wherein this surface has a tangent which makes an angle of 20° to 45° with the upper surface of the panels in the contact point when the aforementioned contact is made. Such a property facilitates easy coupling of two such panels on the respective sides, also in those cases when the top edge on these sides, or at least that side with the female part, is straight, namely without beveled edges or other lowered edges. Preferably, at least the aforementioned surface which comes into contact with the top edge of the other panel during the aforementioned downward movement is made of ABS. In this way, it is possible to achieve a very easy coupling without causing damage to a possibly brittle top layer of the panels.

Preferably, the blocking body is free from sections which extend beyond the aforementioned tangent on the aforementioned surface. Such sections may render coupling more difficult. Preferably, however, the blocking body does have a widened cross section at the end with the locking portion, this widening resulting in a protuberance on the side of the blocking body opposite the surface which comes into contact with the top edge of the panel to be coupled thereto.

It should be noted that achieving easy coupling is of particular interest with panels which comprise a decorative top layer which comprises melamine or other thermosetting or other brittle transparent layers, such as layers on the basis of UV-cured or electron beam-cured lacquer or layers on the basis of varnish. With such panels, beating the panels, for example with a hammer, is preferably avoided when coupling them to each other.

Preferably, the blocking body is a rotatable blocking body, wherein this blocking body comprises a supporting section opposite the end forming the locking portion which is rotatable against a support surface associated with the respective panel and, for example more particularly, in a seat. Preferably, the aforementioned supporting section is in the form of an optionally free end of the blocking body which is positively supported, at least in a vertical direction, by a supporting section or support surface associated with the panel or floor panel. Preferably, such a support surface, at least along a part, extends vertically under the aforementioned first boundary surface in a horizontal direction.

In those cases where the supporting section is designed as a free end, the latter does not experience any effects of adjacent material parts in its supporting section, which benefits an easy pivoting movement of the blocking body. The expression "free end" substantially means that it is simply designed as a projecting leg to which no other parts are attached.

In those cases where the supporting section is designed differently than a free end, it is possible to achieve a pressure-exerting effect with an adjacent material part which may result in a more stable coupling.

Preferably, the blocking body is rotatable about a rotation point, for example about the aforementioned point of support or about a point of the support surface.

Preferably, the panel of the invention has a thickness of 15 millimetres or less, 12 millimetres or less or better still a thickness of 9.5 or 8 millimetres or less. Preferably, the thickness is nevertheless more than 4 millimetres. Obviously, it is not ruled out that the invention may be used with relatively thick panels, such as with panels having a thickness of 12 millimetres to 18 millimetres. Preferably, such cases involve so-called engineered wood panels or panels for prefabricated parquet.

Preferably, the panel of the invention relates to a panel which is substantially composed of a core material and a decorative top layer. Optionally, a backing layer may be used on the side of the core material opposite the top layer. According to the most preferred embodiment, a wood-based board material, such as MDF or HDF (Medium Density Fibreboard or High Density Fibreboard) is used as the core material. It is mainly with such panels that there is a risk of damage to the top layer during coupling. Preferably, the decorative top layer is made substantially of plastic and/or paper, with the decorative top layer preferably comprising a printed pattern. Such panels may be constructed in various ways. Some possibilities are explained in more detail below.

According to a first possibility, the panel is a laminate panel of the DPL or HPL (Direct Pressure Laminate or High Pressure Laminate) type, wherein at least a printed or coloured paper layer covered with a transparent layer of melamine resin is used for the decorative top layer. Optionally, this melamine resin as such may also enclose a transparent paper layer and/or hard particles. This first possibility preferably uses a core material consisting of HDF or MDF and preferably uses a backing layer comprising a paper layer and melamine resin on the underside of the core material. Such a backing layer provides a balancing effect for possible residual tensions which may be present in the top layer. According to the DPL principle, the constituting layers and the core material of such a panel are cured in one pressing step and bonded together. According to the HPL principle, the constituent layers of the top layer of such a panel are cured before they are bonded to the core material in a subsequent step.

According to a second possibility, the panel is a directly printed laminate panel, wherein the decorative top layer is formed at least by providing the core material with a print, optionally via one or more base layers, for example by means of offset printing or a digital printing process, such as inkjet printing. In order to provide some resistance to wear, such a print may furthermore be finished with one or more transparent lacquer layers or melamine layers, such as one or more UV-cured or electron beam-cured lacquer layers. Such transparent layers may furthermore also comprise hard particles. This second possibility preferably uses a core material which consists of HDF or MDF and preferably uses a backing layer which preferably provides a damp-proof barrier, for example by means of a lacquer, on the underside of the core material. According to this second possibility, a panel may be provided whose top layer and optionally also whose backing layer are free from paper layers.

Preferably, the decorative top layer has a thickness of less than 1 millimetre or even less than 0.5 or 0.3 millimetres. This is common with panels of the above first and second possibility. It is in particular with such panels that the invention is most useful. The reason for this is that it is possible to produce an easier vertically active locking system by means of the particular insert of the invention. Furthermore, a coupled position may be achieved by means of the invention, in which there are no or hardly any differences in height between the neighbouring top edges of the coupled panels. In any case, any possible difference in height is preferably limited to a maximum of 0.2 millimetres or even of 0.1 millimetres or less, in such a way that the core material remains hidden. Minimizing differences in height is of particular interest with such thin top layers, as they may wear down relatively quickly during use, due to repeated impact on top edges which project too much. In particular with decorative top layers which comprise melamine or other thermosetting or other brittle transparent layers, such as layers on the basis of UV-cured or electron beam-cured lacquer, preventing excessive differences in height is relevant.

It should be noted that a bevel or other chamfer may optionally be provided on the coupled edges or sides according to any suitable technique. However, the invention is most useful with panels having straight top edges.

Preferably, the locking element is provided in a recess and its locking portion is completely outside the aforementioned recess when it is in the non-coupled position.

As mentioned above, according to an important embodiment, the locking element is arranged in the aforementioned male part. It should again be noted that an easy coupling movement is particularly critical with such an embodiment. After all, when executing the downward movement, the blocking body is pushed inwards through contact with the top edge of the other panel. Such a top edge is far from ideal as a guiding surface for the blocking body, in particular in cases where the top edge is straight, but also in cases where this top edge is provided with a beveled edge or other lowered edge. This contact with the top edge of the other panel may result in the locking element being pushed upwards and the locking element may be pulled out of its position in such a way that coupling becomes impossible. In addition, damage to the aforementioned top edge may occur. In cases where ABS is used as the first polymer, it is possible to make guiding the blocking body beyond the top edge easier.

It should be noted that the present invention is preferably used with embodiments in which the locking element designed as an insert substantially, and better still only, serves as a locking element which assists with vertical locking and therefore not with horizontal locking. Horizontal locking is preferably performed only by parts, such as the aforementioned male part and female part, which are made of the actual panel material or substrate material, more particularly are formed from these by machine. More particularly, the invention preferably relates to embodiments in which the insert is produced separately and is then fitted in an edge of an actual floor panel, optionally in a fixed manner.

It should furthermore be noted that the locking systems of the invention are of particular interest for use in panels which have an effective panel surface of more than 0.4 or more than 0.45 square metres. According to a particular possibility, this involves panels which have an effective panel surface of approximately half a square metre. In this case, it may involve elongate panels having a length of more than 2 metres and a width of approximately 20 centimetres or more, or elongate panels having a width of 40 centimetres or more and a length of 1 metre or more, or square panels with a side of 60 centimetres or more. By means of the locking systems of the invention, it is possible to achieve a particularly convenient installation for these more unwieldy large panels.

BRIEF DESCRIPTION OF THE DRAWINGS

In order to show the features of the invention in more detail, some preferred embodiments are described below by way of example and without being limited thereto, with reference to the accompanying drawings, in which.

DETAILED DESCRIPTION OF VARIOUS EMBODIMENTS

As is illustrated in FIGS. 1 to 6, the invention relates to a floor panel 1 which comprises coupling parts 4-5 on at least two opposite sides 2-3 by means of which two such floor panels 1 can be coupled together.

Figure 3:
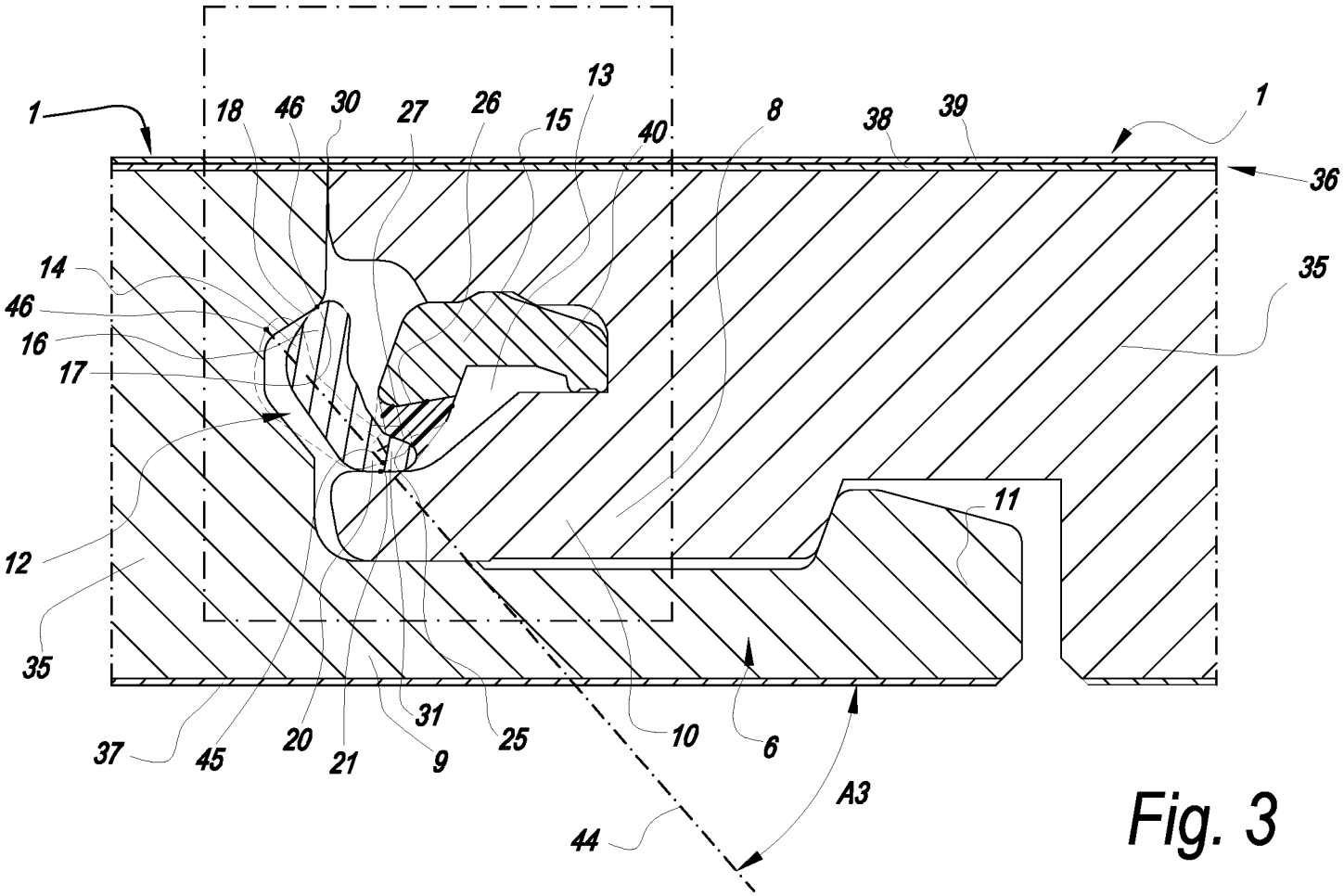
FIG. 3 shows a cross section of two floor panels which are configured according to FIG. 2 in a coupled position.

As is clear from the coupled position in FIG. 3, these coupling parts 4-5 comprise a horizontally active locking system 6 and a vertically active locking system 7. The horizontally active locking system 6 contains a male part 8 and a female part 9, which make it possible for two such floor panels 1 to be connected to each other at the aforementioned sides 2-3 by fitting one of these floor panels 1 with the associated male part 8 in the female part 9 of the other floor panel by means of a downward movement M, which movement M is explained by means of the two different positions in FIGS. 4 and 5, and with FIG. 6 again illustrating the final locked position.

In the example, the male part 8 is formed by a downwardly directed end of a hook-shaped part 10, whereas the female part 9 consists of a seat formed by an upwardly directed hook-shaped part 11.

The vertically active locking system 7 comprises a locking element 12 which is provided in the form of an insert in one of the respective sides, in this case the side 2, more particularly in a recess 13 provided for the purpose. By way of illustration, the locking element 12, or in other words therefore the insert, is shown in a separate position in FIG. 7. As can be seen in this figure, this locking element 12 is designed as a strip. It will be clear that this strip preferably extends along the entire or virtually the entire length of the side 2, for example along at least 75 or even at least 85 percent thereof. According to another possibility, several separate strips can bridge the entire or virtually the entire length of the side 2. Preferably, a strip is present at least centrally along the length of this side 2, irrespective of the length over which this strip extends.

In the example, this strip is made of plastic and it is preferred if the strip has a continuous cross section along its entire length, as a result of which it is simple to manufacture and/or fit. Such a strip may be produced, for example, using an extrusion technique and may be cut to the desired length. The same continuous strip can thus be used for panels of different sizes, for example in each case cut to size for the respective side to which the strip is to be fitted.

In the illustrated example, the locking element 12 is composed of at least a rotatable blocking body 14 and a securing section 15. In the embodiment from FIGS. 2 to 6, the blocking body 14 consists of the entire upright part, while the securing section 15 is formed by a part which is directed more horizontally. Preferably, however, the securing section 15 has a convex top side and a concave bottom side, as in all examples. In this way, the securing section can have a virtually constant wall thickness which corresponds to the wall thickness of the blocking body 14, but is smaller than the overall height of the recess 13 in which the locking element 12 or the strip is fitted. The resultant bridge shape of the securing section 15 makes it possible to fit the locking element 12 in a relatively large recess 13 in a stable and repeatable way. A relatively large recess 13 can be produced more easily by means of cutting tools. The bridge shape of the securing section 15 permits some deformation in order to allow it to be fitted in the recess 13, the height of which, in addition, does not necessarily have to be accurate.

In the example, the end 16 of the blocking body 14 which may be removed by rotation functions as a stop-forming locking portion 17 and can cooperate with a locking portion 18 of a similar coupled floor panel 1. In this case, the locking portion 18 is preferably formed by a section which defines a stop-forming face 19 which is provided on the side 3 for this purpose, and is preferably produced in the core of the floor panel 1 by machine. The action of the vertically active locking system can easily be inferred from the figures and is based on the principle that, as is shown FIGS. 4 and 5, the blocking body 14, due to the contact with the edge of the other floor panel, is elastically folded in when the respective floor panel is lowered, after which, once the floor panels have reached the same plane, the blocking element or blocking body 14 rotates back outwards in order to position itself under the locking portion 18, thus producing the coupled position of FIGS. 3 and 6.

In the example, the rotatable blocking body 14 opposite the end 16 forming the locking portion 17 comprises a supporting section 20 which is rotatable against a support surface 21 associated with the respective floor panel 1. The expression "supporting section 20" in the embodiment from FIGS. 2 to 6 is thus understood to mean the end 22 opposite the locking portion 17, in this case the bottom end, of the blocking body 14.

Furthermore, in the example, the blocking body 14 as such is free from pivoting parts and bending parts between the locking portion 17 and the supporting section 20, in other words between its ends 16 and 22. To this end, the blocking body 14 is therefore relatively thick and preferably forms a rigid body, which is understood to mean that the blocking body 14 is not able to be notably deformed between its ends when it is subjected to loads which may usually occur with "push-lock" couplings.

Furthermore, in the illustrated embodiment, the supporting section 20 is configured as a free end which is at least in a vertical direction positively supported by a supporting section 23 associated with the floor panel 1, more particularly support surface 21.

In general, it can be stated that the locking element 12 preferably consists of a strip which is secured in a recess, in the illustrated example thus the recess 13, in the floor panel 1 and that securing sections are present here which retain the strip in the recess. More particularly, it is preferred for the strip, such as in this case, is click-fitted in the recess and/or, according to a variant, is enclosed therein by its design. According to another variant, the securing section 15 in the recess 13 may be adhesively bonded to the panel 1.

It should be noted that other techniques for securing or retaining such a strip in the recess are possible, for example by sticking, clamping or the like.

The embodiment illustrated by means of FIGS. 2 to 6 furthermore shows the features that the locking element 12 comprises a bending zone 24 made of a material which differs from the material of the blocking body 14, wherein this bending zone 24 has both a first boundary surface 25 with the aforementioned blocking body 14 and a second boundary surface 26 with the aforementioned securing section 15. In this case, this is an elastic bending zone 24.

Figure 1:
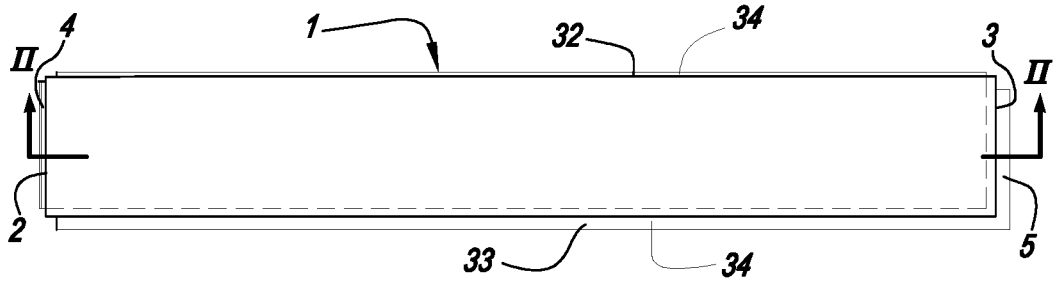
FIG. 1 diagrammatically and in top view shows a floor panel according to the invention.
Figure 2:
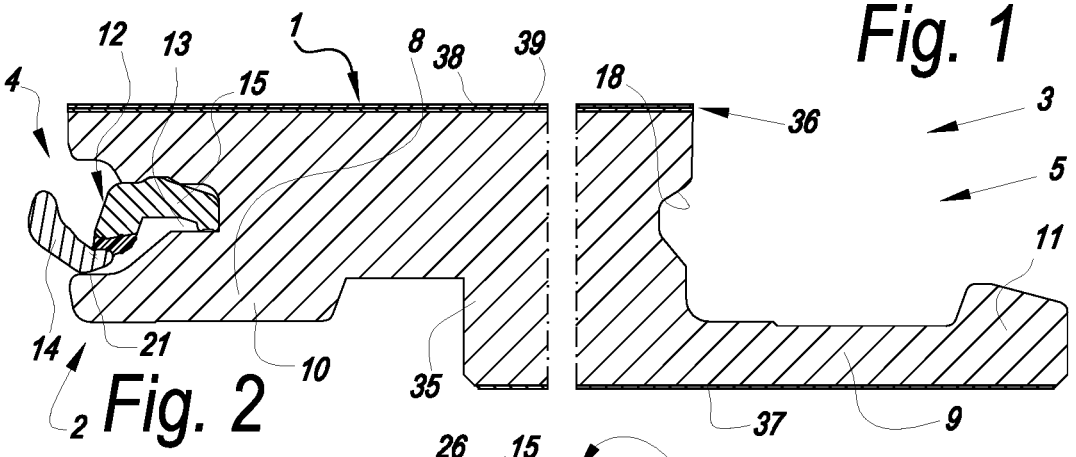
FIG. 2 shows a cross section on an enlarged scale along line II-II in FIG. 1.
Figure 4:
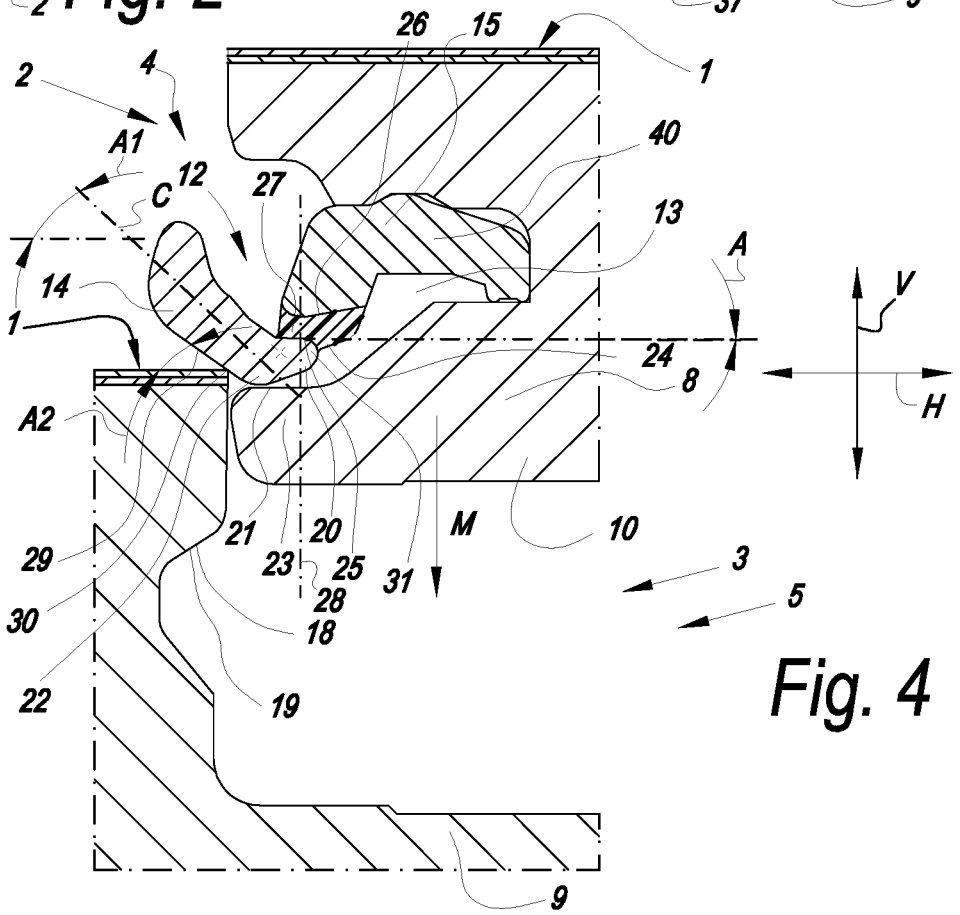
FIGS. 4 to 6, in a view of the area denoted by F4 in FIG. 3, show the respective floor panels in various stages of the coupling movement.

As is illustrated in FIG. 4, in the non-coupled position, the blocking body 14 and the securing section 15 extend one under the other in the horizontal direction H, at least along a part 27. In this case. points of both the first boundary surface 25 and the second boundary surface 26 are situated on a vertical line, for example on the line 28, one above the other. In the examples, the first boundary surface 25 and the second boundary surface 26 extend one below the other, at least over a third, and here even over at least half the entire smallest boundary surface, the smallest boundary surface in this case being the first boundary surface 25.

FIG. 4 furthermore clearly shows that, in the non-coupled position, the first boundary surface 25 broadly extends in a direction which encloses an angle A of less than 45° with the upper surface of the panels 1. In the example, the angle A is less than 10°, and here even approximately 0°, in the non-coupled position.

FIG. 4 furthermore shows that, in the non-coupled position, the blocking body 14 can have an orientation in which the central line C of the blocking body forms an angle A1 of less than 60° with the horizontal or, in other words, with the upper surface of the panels 1 or the panel surface. In the example, this angle A1 is less than 50°, namely approximately 45°.

Furthermore as illustrated in FIG. 4, the blocking body 14 here has a surface 29 which comes into contact with the top edge 30 of the other panel during the coupling movement M. The respective surface 29, in the example situated on the downwardly directed side of the blocking body 14, has a tangent 29A which forms an angle A2 of 20° to 45° with the horizontal or the upper surface of the panels in the contact point when contact is made as illustrated here. In this case, this angle A2 is approximately 35°.

The properties illustrated by means of FIG. 4 are all of particular interest, separately or in combination, if the strip is used in the male part 8 and/or if the panel 1 which is to be coupled has a straight top edge 30, as is the case in the examples.

Figure 6:
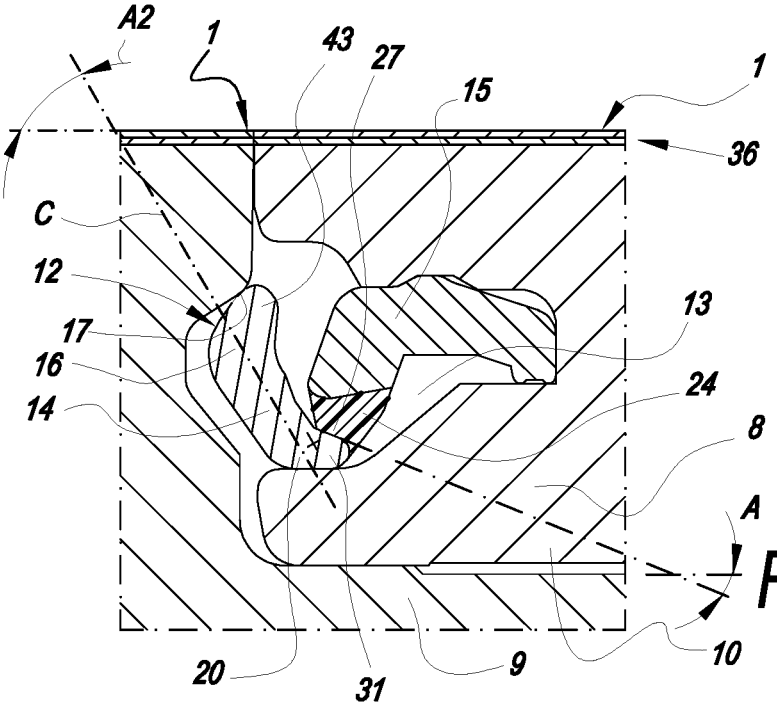

FIG. 6 clearly shows that in this case preferred measures are present in the coupled position of two such panels 1. The blocking body 14 extends under the securing section 15, at least along a part, at least points, and preferably relatively large sections, of the first and second boundary surface 25-26 are situated one above the other on a vertical line, and the first boundary surface 25 extends in a direction which encloses an angle A with the upper surface of less than 45°.

Figure 5:
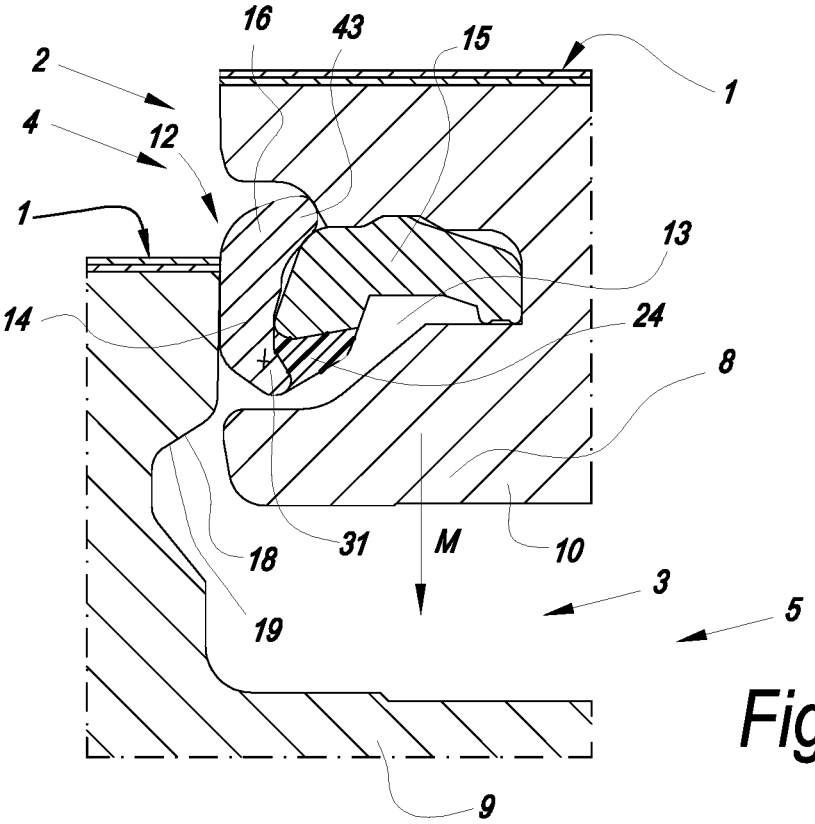

FIG. 5 shows a position in which the aforementioned blocking body 14 is situated entirely under the top side or the upper surface of the panel 1 in which it is secured. In this case as well, the blocking body 14 extends under the securing section 15, at least along a part 27, and at least points, and preferably relatively large sections, of the first and second boundary surface 25-26 are one above the other on a vertical line. However, in the example and in this position, the first boundary surface 25 extends in a direction which encloses an angle A with the upper surface of more than 45°.

In each of the positions illustrated in FIGS. 4 to 6, the blocking body 14 and the securing section 15 extend one under the other in such a way that, in the respective position, they maintain a vertical distance between one another.

It will be clear that the locking element 12, in the examples, is provided as an insert in a recess 13 in the male part 8 and that the blocking body 14 with its locking portion 17 is directed upwards. This relates to the most preferred embodiment of the invention. However, it is not ruled out that the insert could be fitted in the female part 9, in which case its locking portion 17 would then preferably be directed downwards.

FIGS. 3 and 6 furthermore show that, in the coupled position of two such panels 1, the aforementioned support surface 21 extends in a horizontal direction preferably at least along a part vertically under the first boundary surface 25. The same applies to the supporting section 20 of the blocking body 14.

FIGS. 2 to 7 illustrate another preferred feature of the invention, namely that the blocking body 14 has a hook-shaped protuberance 31 on its underside or on that side which faces away from the locking portion 15 thereof or the end 22, and that the section of the blocking body 14 which extends under the securing section 15 is at least a part of this hook-shaped protuberance 31.

FIGS. 4 and 6 show successive stages of the coupling movement M. FIG. 4 shows the position at the start of contact between blocking body 14 and the other panel 1 to be coupled to the respective panel 1. At this moment, a force is generated in the vertical direction V which may result in a rotation of the blocking body 14 and also in a pushing up of the locking element 12 which may lead to a possible blocking. FIG. 5 shows that it is not ruled out that, with the panels 1 of the invention, the locking element 12 may be pushed up during coupling to a certain extent, but this may be so limited that it does not compromise the ease of coupling.

Figure 7:
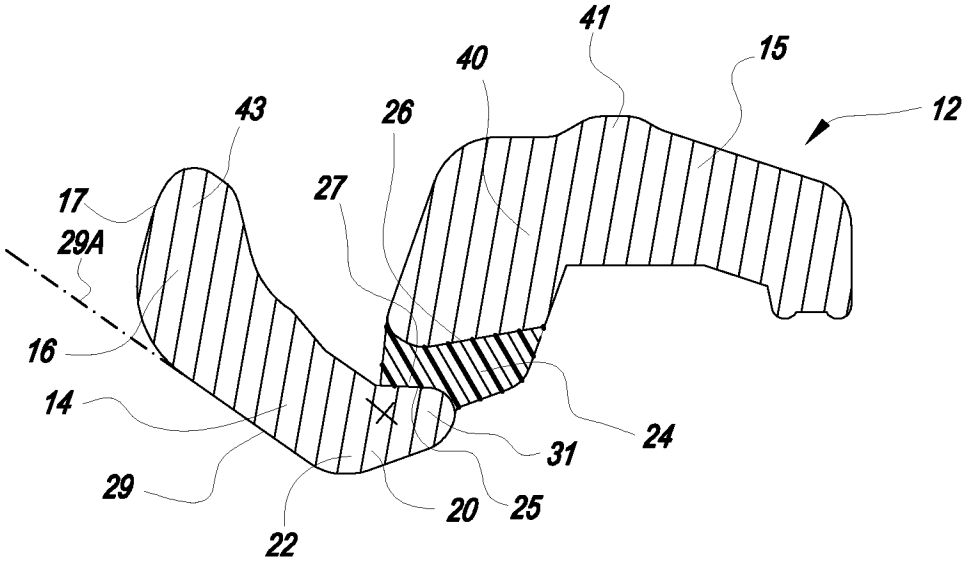
FIG. 7 shows the insert of the floor panels from FIGS. 1 to 6 on an enlarged scale.
Figure 11:
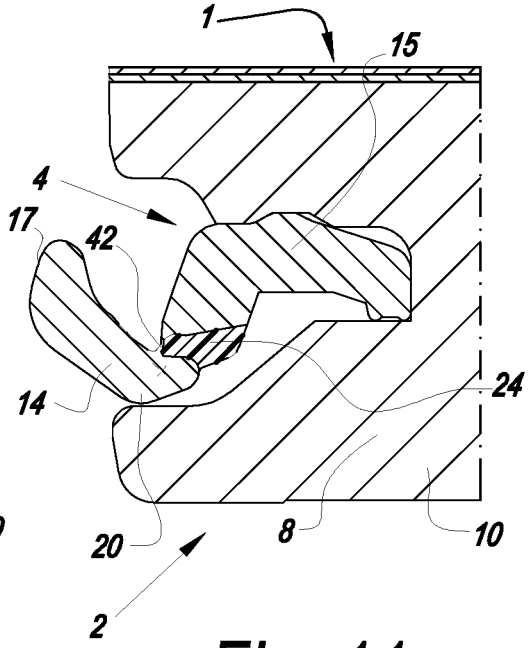

FIG. 7 furthermore shows that the locking element 12 consists of a coextruded plastic strip which, viewed in cross section, such as according to the view from FIG. 11, is composed of two or more zones, in this case three zones which are made of plastics with different properties. In the example, a first zone is formed by the rotatable blocking body 14, a second zone by the bending zone 24 and a third zone by the securing section 15.

For example, the blocking body 14 may be made of ABS (acrylonitrile butadiene styrene); and the bending zone 24 consists of a mixture of 20% by weight of acrylonitrile butadiene styrene and 80% by weight of thermoplastic polyurethane (TPU). Preferably, the securing section 15 is made of the same polymer as the blocking body 14.

In another example, the bending zone 24 is made of thermoplastic polyurethane (TPU); and the blocking body 14 is made of a mixture of 80% by weight ABS (acrylonitrile butadiene styrene) and 20% by weight of thermoplastic polyurethane (TPU). Preferably, the securing section 15 is made of the same polymer mixture as the blocking body 14.

The bending zone 24 thus preferably comprises an elastic material and more particularly a material which, as such, is more pliable than the material of the blocking body 14. Preferably, this is also plastic and, in the most preferred embodiment, the bending zone 24 is produced as a single part with the blocking body 14 by means of coextrusion. In the figures, the coextruded materials are shown by means of a different hatching.

In general, it should be noted that a locking element 12 in cross section may only have small dimensions, since this has to be incorporated in the edge of floor panels which, in practice, have a thickness which is usually less than 2 cm, and the thickness of which in many cases is even less than 1 cm. The space which is then available for the locking element 12 is therefore often only in the order of magnitude of 5 millimetres or less. If various degrees of flexibility have to be incorporated in the locking element 12 with such small dimensions, the options are limited if one wants to achieve this in a traditional way using different thicknesses. By means of coextrusion, the range of options to incorporate different degrees of flexibility, and thus also a different elasticity, is increased, depending on the intended effect.

It should be noted that, as is illustrated in the figures, the locking portion 17 of the blocking body 14 is preferably in the form of a widened end of the blocking body 14, as a result of which more space is available to produce the locking portion with a desired surface. Such a surface is preferably designed in such a way that the blocking body 14 can rotate further when using the panels or floor panels while maintaining a vertical locking and even producing an increasingly intense cooperation between the locking portion 17 and the locking portion 18 of the opposite panel 1. Thus, for example, a so-called cam surface may be used, as is described in WO 2009/066153.

As is illustrated in the figures, the locking element 12 and the recess 13 are designed in such a way that the locking portion 17 of this locking element 12 is entirely outside the recess 13 in the free, non-coupled position of the respective floor panel 1.

FIG. 6 furthermore shows that, in the coupled position, the blocking body 14 assumes an orientation in which the central line C of the blocking body 14 encloses an angle A4 with the upper surface which is greater than the angle A1 defined above. The difference is at least 5°, and in this case even more than 10 or 15°. In this way, a strong clamping effect is achieved.

According to a preferred embodiment of the invention, the bending zone 24 is generally in the coupled position, such as in the examples, subjected to a tensile load, with this tensile load forcing the blocking body 14 to return to its non-coupled position, in which it encloses a smaller angle with the upper surface. This tensile load can ensure contact between the locking portion 17 of the blocking body 14 against the locking portion 18 of the panel 1 which is coupled thereto. In such a case, a continuous tension in the contact can be achieved.

In the coupled position, such as in FIG. 6, the orientation of the first boundary surface 25 results in a strong moment action on the blocking body 14, due to the abovementioned tensile forces.

Preferably, the aforementioned angle A4, as in the example from FIG. 6, is less than 90°, and preferably also less than or equal to 60°, or less than 50°.

In the case of rectangular floor panels 1, either elongate or square, it is clear that coupling parts 34 may also be provided on the second pair of opposite sides 32-33, which, in the coupled position, preferably also result in a locking in a vertical direction at right angles to the face of the coupled panels 1 and in a locking in a horizontal direction in the plane of the coupled panels and at right angles to the respective sides 32-33. These coupling parts 34 on the second pair of sides 32-33 may also be designed as a "push-lock" coupling, optionally in accordance with the present invention. Preferably, coupling parts 34 will be used on the second pair of sides 32-33 which allow mutual coupling by means of a rotating movement W between two floor panels 1 to be coupled and/or by means of a sliding movement which results in a snap connection. Such coupling parts are well-known from the prior art and are described, for example, in WO 97/47834.

Figure 8:
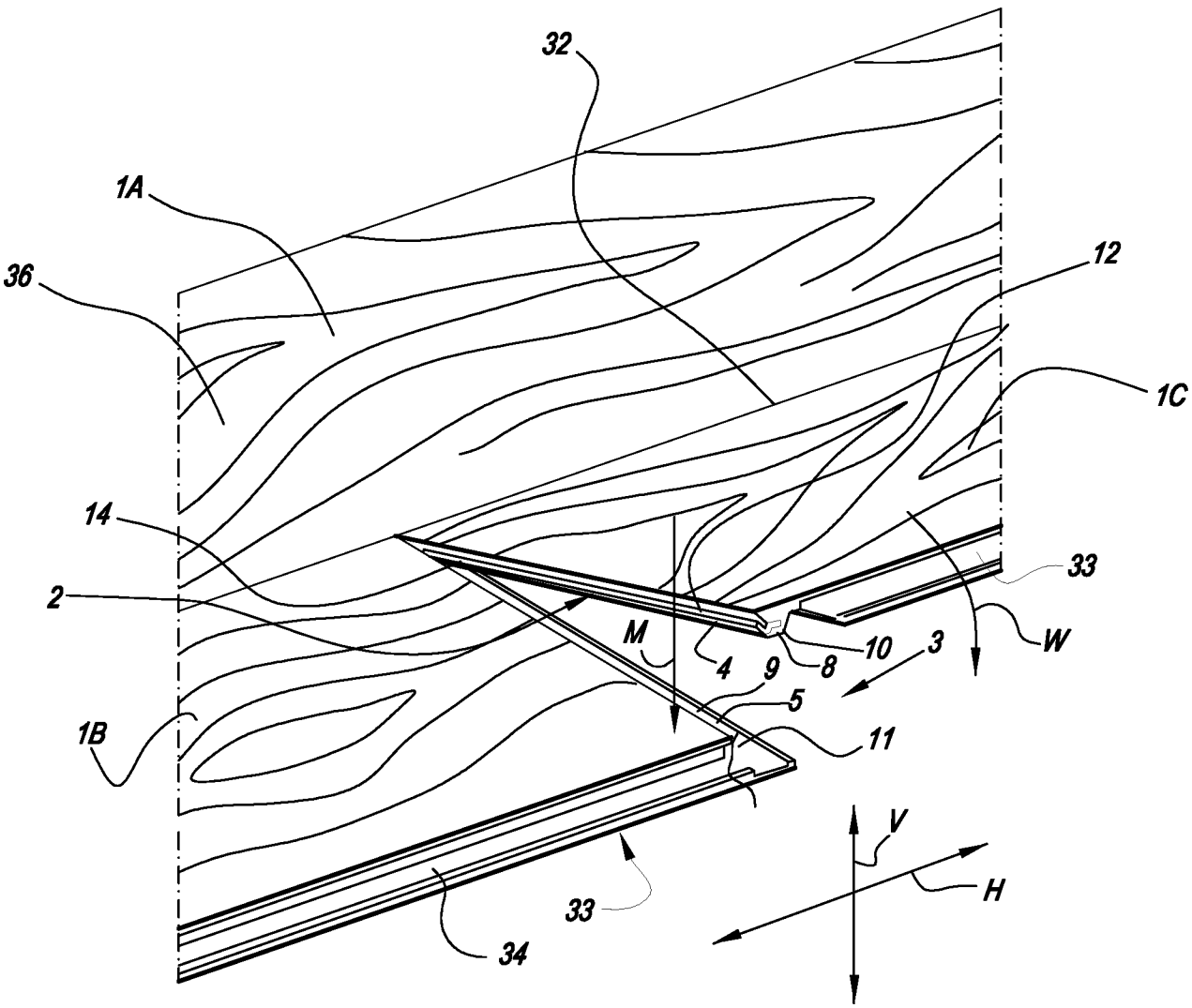
FIG. 8 shows a perspective view of the way in which the floor panels from FIGS. 1 to 6 can be coupled together.

In the most preferred embodiment, coupling parts 34 are used on the second pair of sides 32-33 which allow at least a connection by means of a rotating movement W, since this makes it possible to install the floor panels 1 as illustrated in FIG. 8 in a simple manner. After all, a new floor panel 1C to be laid can then easily be connected to the preceding row of floor panels 1A along its side 33 by rotation, precisely next to a previous floor panel 1B in the same row. When rotating the floor panel down, the male part 8 of the new floor panel 1C to be laid then automatically engages in the female part 9 of the preceding floor panel 1B without another operation having to be performed. In the case of elongate floor panels 1, it is therefore preferred if the so-called "push lock" connection is situated on the short sides 4-5.

It will be clear that the coupling according to the invention can be used in combination with any desired floor panel 1, such as with so-called prefabricated parquet, more particularly in so-called "engineered wood". In such a case, these are floor panels which are constructed from a core material 35 composed of strips, a top layer 36 made of wood and a backing layer made of wood. The top layer 36 then consists of good-quality wood which functions as a visible decorative layer. The backing layer 37 may consist of a less expensive kind of wood. The strips preferably also consist of a less expensive kind of wood, for example soft wood. It is preferable, however, to use strips on the ends of the floor panels 1 which are made of a material which is relatively stable and is suitable to provide the desired profile shapes therein, for example by cutting. In a practical embodiment, these strips are made of MDF (Medium Density Fibreboard) or HDF (High Density Fibreboard). It will be clear that the invention may also be used in combination with other forms of "engineered wood", for example in which the core consists of one uninterrupted MDF/HDF panel or of a plywood panel.

The figures in each case show the use in panels which substantially consist of a core material 35 and a decorative top layer 36. More specifically, the examples relate to a laminate floor panel 1, in this case a so-called DPL (Direct Pressure Laminate), which is composed, in a known manner, of a core material 35, for example of MDF or HDF, a top layer 36 based on one or more resin-impregnated layers, for example a printed décor layer 38 and a so-called overlay 39, as well as a backing layer 37 which also consists of one or more resin-impregnated layers, wherein the entirety is consolidated using pressure and heat.

Obviously, uses in other floor panels are not ruled out.

In general, the invention is most useful with floor panels whose total thickness is less than 1 centimetre.

In general, it is preferred if a locking element 12 according to the invention provides a stable support in the vertical direction V, while providing a flexible mobility in the horizontal direction H, i.e. in the direction of rotation. The use of coextruded parts assists herewith.

By means of the invention, an improved click-fit effect is achieved with locking systems of the specific type mentioned in the introduction, mainly in those cases in which the blocking body 14 is directed upwards. In such cases, click-fitting may be difficult with the systems from the prior art. As is illustrated in FIG. 4, the upwardly directed blocking body 14 which contains, for example, substantially ABS, during coupling of two such panels 1 by means of a downward movement M, slides over a sharp edge, in this case over the top edge 30 of the opposite panel. In the examples, the more flexible plastic of the bending zone ensures an easier downward coupling movement M, in which the risk or the tendency of the panels 1 of being pushed apart in the horizontal direction H resulting in an inferior coupling is minimized. The invention is of particular interest when working with laminate panels 1. In this way, the risk of damage to the thin top layer 36 made of laminate during coupling of the panels 1 is minimized.

According to the example from FIGS. 2 to 7, in the non-coupled position, the blocking body 14 and the securing section 15, more particularly the clamping section 40, extend horizontally, at least along a section, one under the other, while maintaining a vertical distance between one another. In the coupled or non-coupled position of two such panels 1, in this case in both, the aforementioned support surface 21 extends in the horizontal direction H, at least along a section, vertically under the aforementioned optionally elastic bending zone 24 and under the aforementioned securing section 15 or more particularly the clamping section 40.

Figure 9:
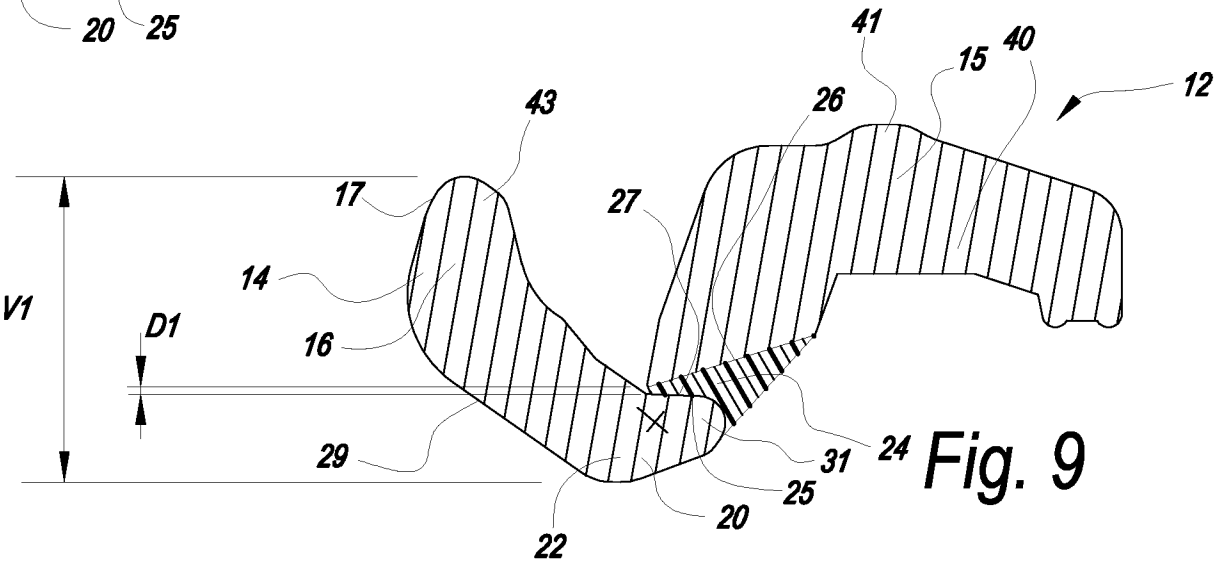
FIG. 9, in a view similar to that of FIG. 7, shows a variant of such an insert which may be used as locking element in the panels of the invention.

FIG. 9 illustrates that the smallest vertical distance D1 between the respective sections of the blocking body 14 and the clamping section 40 which extend one under the other is smaller than 0.4 millimetres, or is at least smaller than 5 percent of the vertical height V1 of the blocking body 14 in the free position. This applies to the position in which the locking element 14 is not situated in the recess 13. Such a small distance D1 results in further minimalizing shear in the bending zone 24 at the start of the coupling movement M. The degree to which the blocking body 14 can be pushed up is limited even further than in the example from FIG. 8.

In the example from FIGS. 7 and 9, the locking element 12 has an elastic bending zone 24 which forms a connection between the securing section 15 and the rotatable blocking body 14. This elastic bending zone 24 extends between the respective sections of the blocking body 14 and the securing section 15 which extend one under the other.

In the examples from FIGS. 7 and 9, the aforementioned locking element 12 is fitted in the aforementioned male part 8, and the aforementioned rotatable blocking body 14 is directed upwards. In this case, in the coupled, but also in the non-coupled position, the rotatable blocking body 14 extends horizontally under the securing section 15 or clamping section 40 at least along a part.

FIGS. 7 and 9 furthermore illustrate that the blocking body 14 has a surface 29 which comes into contact with the top edge 30 of the other panel 1 during the aforementioned downward movement M, wherein this surface 29 has a tangent 29A which makes an angle A1 of 20 to 45° with the upper surface of the panels 1 in the contact point when this contact is made. This measure leads to a smooth installation of the panels 1.

The embodiment from FIGS. 7 and 9 is also special because the insert, more particularly the clamping section 40, is provided with a locking part, in this case a protuberance 41, which makes it possible to click-fit this clamping section 40 in the core material 35 of the panel 1, more particularly in a recess 13 which is provided in the core material 36 for the purpose.

The inserts from FIGS. 7 and 9 preferably consist of a coextruded plastic strip and as such form part of the invention.

Figure 10:
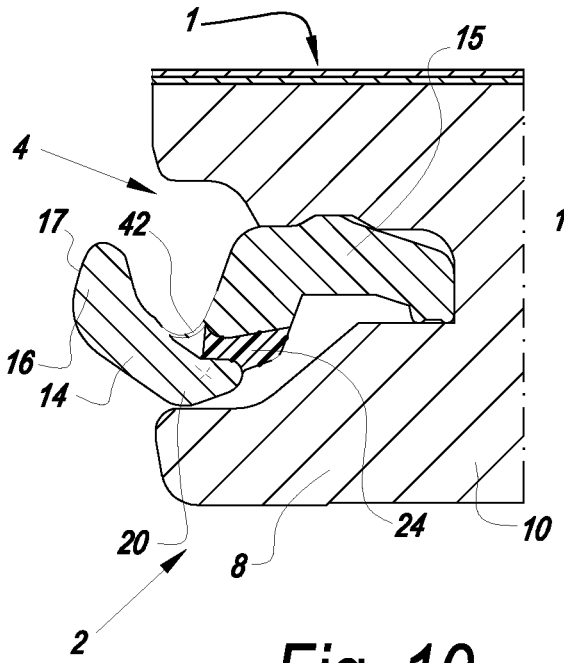
FIGS. 10 and 11, in a view similar to that of FIG. 4, show some variants.

In the examples from FIGS. 7 and 9, the bending zone 24 forms a connection, in these cases even the only connection, between the blocking body 14 and the securing section 15. FIGS. 10 and 11 show that not only is a connection formed by the bending zone 24 made of a different material than the blocking body 14 not ruled out, but neither is an additional connection 42, optionally made of the same material as the blocking body 14. In the case of FIG. 10, the additional connection 42 is made by means of a separate film hinge made of the same material as the blocking body 14. Here, the term "separate" is understood to mean that the material of the film hinge does not, or hardly, come into contact with the material of the bending zone 24. In the case of FIG. 11, an additional connection 42 by means of a film hinge made of the same material as the blocking body 14 has also been used. In contrast with the embodiment from FIG. 10, the film hinge from FIG. 11 is a film hinge which flanks or delimits the bending zone 24.

With the locking elements 12 illustrated in the figures, the blocking body 14 as such is in each case free from pivoting parts and bending sections, and thus forms a rigid body.

As is illustrated in the figures, the blocking body 14 is preferably free from parts which extend beyond the aforementioned tangent 29A on the aforementioned surface 29. Such sections may render coupling more difficult. As is shown in the examples, the blocking body preferably does have a widened cross section at the end 16 with the locking portion 17, this widening resulting in a protuberance 43 on the side of the blocking body 14 opposite the surface 29 which comes into contact with the top edge 30 of the panel 1 to be coupled thereto.

Due to the presence of the hook-shaped protuberance 31 and the protuberance 43 at the ends 16 and 20, respectively, the locking elements 12 in the figures have a concave side facing the recess 13, while the surface 29 on the side of the locking element facing away from the recess 13 is preferably convex, as in the examples. FIG. 5 shows that, in the respective position, the concave side can cooperate with the securing section 15 which makes it possible to provide additional stabilisation of the locking element 12 during the coupling movement M. In the example from FIG. 5, the protuberance 43, at the end 16 with the locking portion 17, rests on top of the securing section 15.

It should furthermore be noted that, where in the context of the invention a vertical direction is mentioned, such as a locking in vertical direction, this actually refers to floor panels. In general, this is understood to mean the direction at right angles to the plane of the panels, irrespective of the fact whether these are floor panels, ceiling panels, wall panels or other panels. Where a horizontal direction is mentioned, such as a locking in the horizontal direction, this also refers to floor panels. In general, this is understood to mean the direction in the plane of the panels and at right angles to the respective edge of the panel. Where a downward movement is mentioned, this is generally understood to mean a movement of the male coupling part towards the female coupling part in a direction which extends perpendicularly to the plane of the panels. Such a movement on one pair of sides is preferably achieved in a way as is illustrated in FIG. 8, namely by performing a rotating movement W on the second pair of sides. Where the expression "upwardly or downwardly directed" is used, this is generally understood to mean facing the decorative side or facing away from the decorative side, respectively.

It will be clear that the expression "useful surface of a panel" is understood to mean the surface which is visible or usable in the final covering which consists of several such panels coupled together. In other words, this relates to the surface of the decorative side of the panels.

Figure 14:
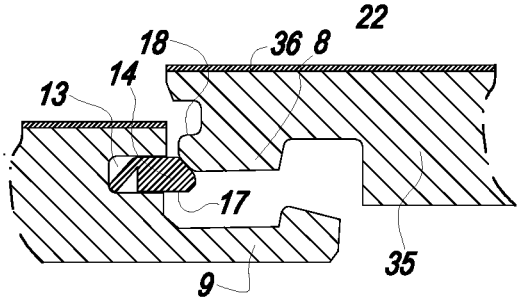
FIGS. 14 and 15, in a view similar to that of FIG. 13, but on a smaller scale, show variants.
Figure 15:
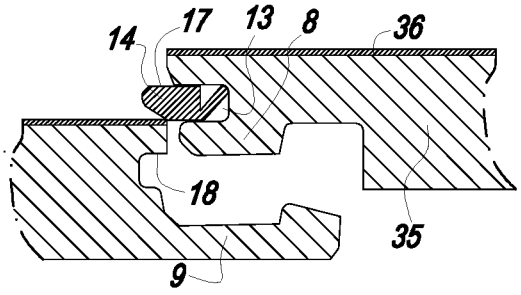

It will furthermore be clear that the invention may not only be used with strips having rotatable blocking bodies, but also with other separate strips which have a blocking function in a vertical direction. Thus, the invention may also be used, for example, with strips which comprise a blocking body which is slidable or bendable in a plane, for example in a horizontal plane. FIGS. 14 and 15 show an example thereof.

It should furthermore be noted that, in those cases in which the locking portion 17 of a rotatable blocking body 14 of a locking element 12 is facing upwards, it is very advantageous for ease of coupling when the central line C of the blocking body 14, in the non-coupled position, encloses an angle A1 of less than 60°, and better still of less than 50° degrees with the horizontal or the upper surface of the panels 1.

It should also be noted that FIG. 3 also illustrates a preferred feature in which, in the non-coupled position, a line 44 which is defined by, on the one hand, the point of tangency 45 of the horizontal tangent with the supporting section 21 and, on the other hand, the central point 46 of the stop-forming locking portion 17, encloses an angle A3 with the horizontal or the panel surface of less than 60°, less than 50° or better still of less than 45° or of approximately 40° with the panel surface. It should be noted in this case, that the position of the central point 46 of the stop-forming locking portion 17 is determined in the coupled position, whereas the aforementioned line 44 and the associated orientation, more particularly the angle A3 which is enclosed with the horizontal or the upper surface, is determined as such in the non-coupled position.

Figure 12:
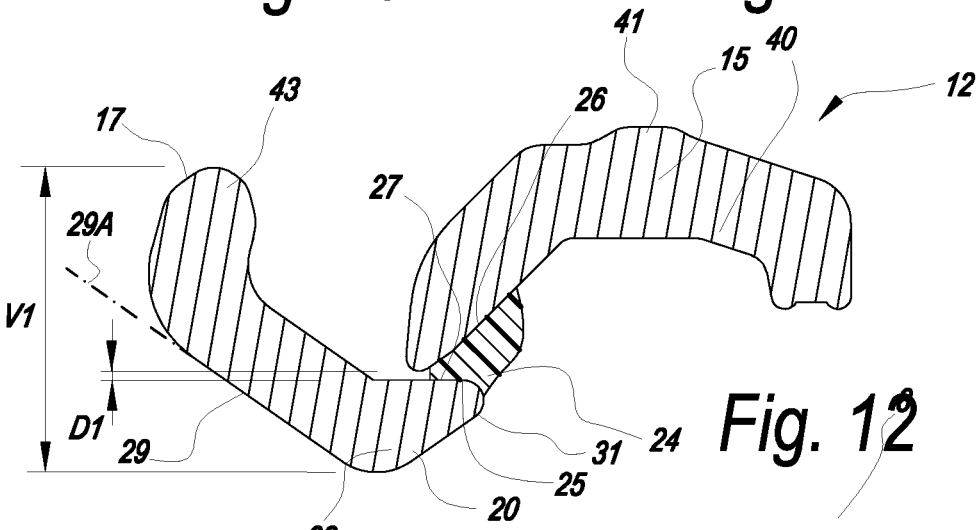
FIGS. 12 and 13, in views similar to those of FIGS. 7 and 3, respectively, show another variant.
Figure 13:
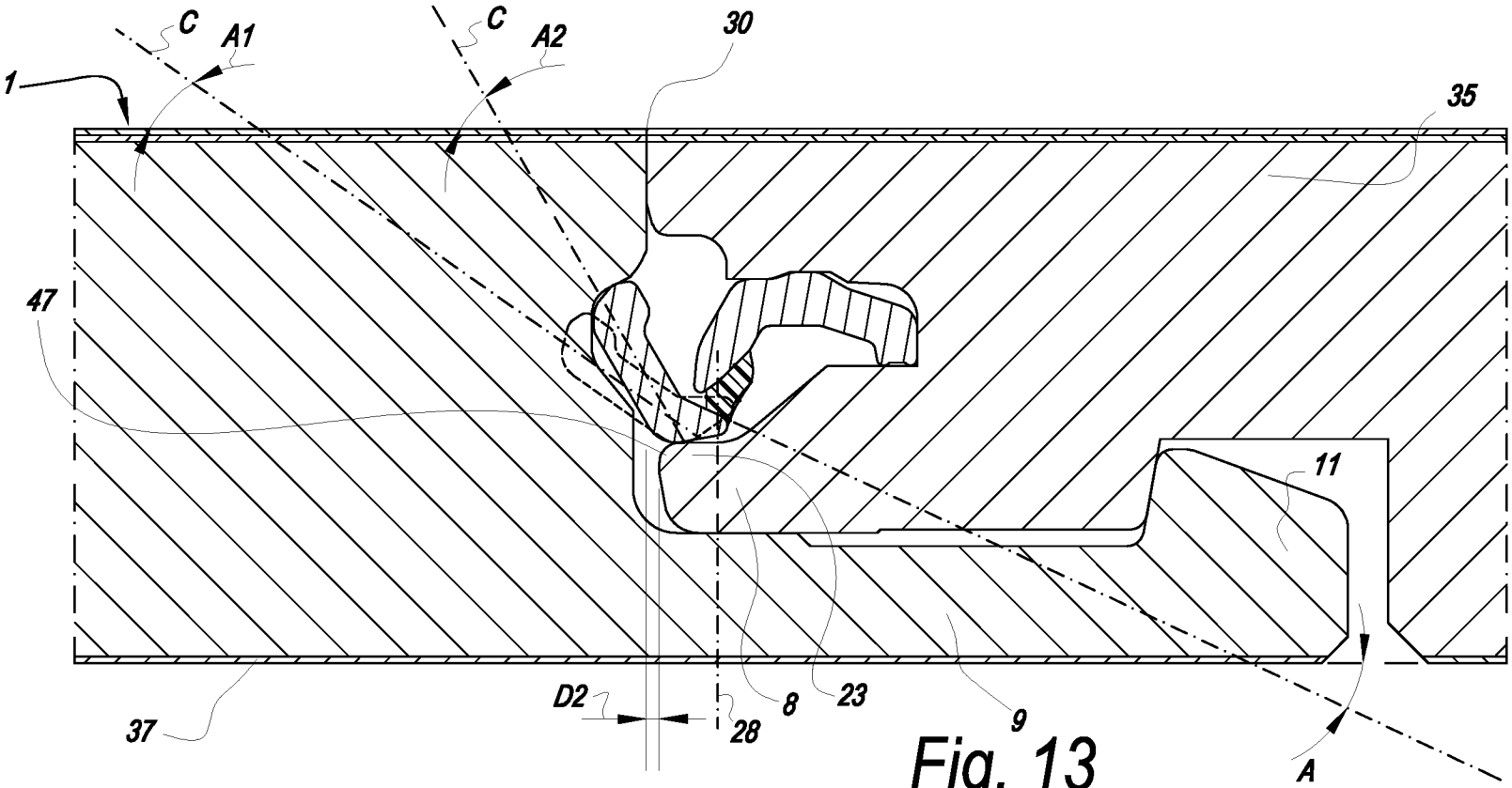

FIGS. 12 and 13 show another variant of a locking element 12 and floor panels 1 in which such a locking element 12 is used. In this case, the blocking body 14 has an orientation in the coupled position, in which the central line C thereof forms an angle A4 with the panel surface which is greater than the angle A1 which is formed in the non-coupled position. The difference between both angles is more than 10°. In this case, the difference is approximately 25°. In the coupled position, the angle A4 is more than 50°, but less than 90°. In this case, the angle A4 is approximately 60° and the angle A1 is approximately 35°. Furthermore, the first boundary surface 25, in the coupled position, encloses an angle A of less than 45°, in this case of approximately 25°, with the upper surface of the panels 1.

The locking element from FIG. 12 furthermore has the particular feature that, at the location of the minimum vertical distance D1, there is an interspace between the securing section 15 and the blocking body 14.

The embodiment of the panels 1, as illustrated by means of FIG. 13, furthermore has the particular feature that the distal end 47 of the supporting section 23 only extends up to a distance D2 from the top edge 30, and thus does not extend beyond the top edge 30. This has the effect that easy assembly remains possible, even with non-perpendicular floor panels. The distance D2 is preferably between 0.1 and 0.5 millimetres.

It should furthermore be noted that where the vertical distance D1 is mentioned, this refers to the minimum vertical distance between sections of the blocking body 14 and the securing section 15 which are on the same vertical line. At the location of this vertical distance, there may optionally be an interspace between the blocking body 14 and the securing section 15.

Figure 16:
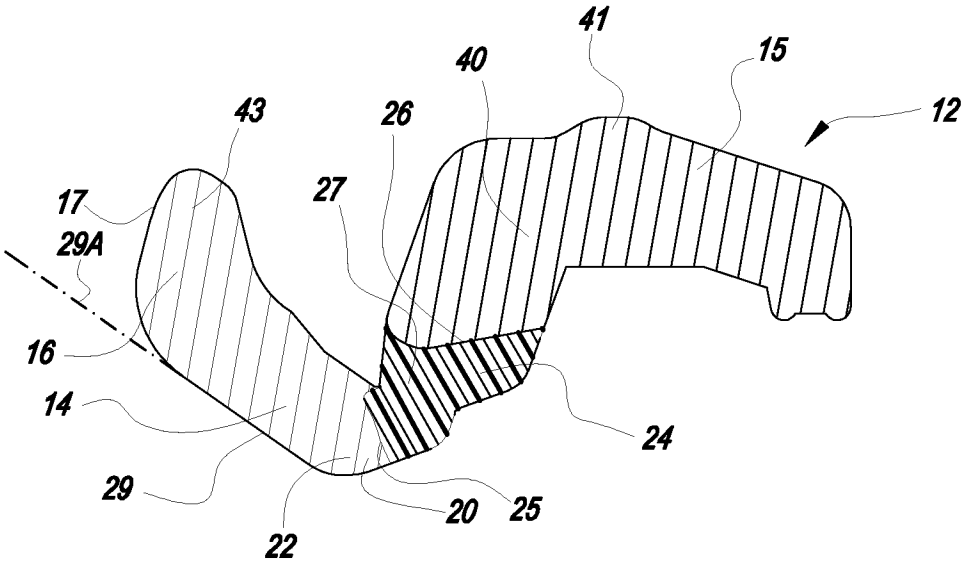
FIG. 16 shows another example of an insert which may be used with the invention.

FIG. 16 shows another example of an insert which can be used with the invention. The reference numerals have the same meaning as in FIG. 7. With the insert from FIG. 16, the first boundary surface 25, between bending zone 24 and the blocking body 14, is positioned differently. This has the advantage that the stress concentrations in the first boundary surface 25 are lower when using the insert for coupling panels, as a result of which the risk of the insert failing is reduced.

The present invention is by no means limited to the embodiments described by way of example and illustrated in the figures, but such panels may be brought about in different forms and sizes without departing from the scope of the invention.

The invention claimed is:

1. A panel which comprises coupling parts on at least two opposite sides by means of which coupling parts two such panels can be brought into a coupled position; wherein these coupling parts form a horizontally active locking system and a vertically active locking system;

wherein the horizontally active locking system has a male part and a female part which allow two such panels to be connected to each other on the aforementioned sides by fitting one of these panels with the associated male part in the female part of the other panel by means of a downward movement;

wherein the vertically active locking system comprises a locking element which is fitted in one of the respective sides in the form of an insert;

wherein this locking element comprises at least a blocking body, a securing section and a bending zone; wherein the aforementioned bending zone consists of an elastic bending zone which forms a connection between the securing section and the blocking body;

wherein the locking element consists of a strip which is secured in a recess in the panel;

wherein the locking element consists of a coextruded plastic strip which, viewed in cross section, consists of several zones made of plastic with different properties, including at least a first zone formed by the aforementioned blocking body, and, at least a second zone formed by the aforementioned bending zone;

wherein the blocking body is made of a first polymer, said first polymer is at least 60% by weight of the blocking body;

wherein the bending zone is made of a second polymer, said second polymer is at least 60% by weight of the bending zone;

wherein the blocking body is made of a mixture comprising the first polymer and the second polymer; or wherein the bending zone is made of a mixture comprising the second polymer and the first polymer.

2. The panel as in claim 1, wherein, in the bending zone, the percentage by weight of the first polymer in the mixture of the second polymer and the first polymer is more than 10% by weight.

3. The panel as in claim 1, wherein, in the blocking body, the percentage by weight of the second polymer in the mixture of the first polymer and the second polymer is more than 10% by weight.

4. The panel as in claim 1, wherein the blocking body at one end forms a stop-forming locking portion which can cooperate with a locking portion of a similar coupled panel.

5. The panel as in claim 1, wherein the securing section retains the strip in the recess.

6. The panel as in claim 1, wherein the first polymer is acrylonitrile butadiene styrene.

7. The panel as in claim 1, wherein the second polymer is a polyurethane or a polyurethane-based plastic.

8. The panel as in claim 1, wherein the securing section is made of the same polymer or polymer mixture as the blocking body.

9. The panel as in claim 1, wherein the aforementioned blocking body is a rotatable blocking body.

10. The panel as in claim 1, wherein the aforementioned locking element is fitted as an insert in a recess in the aforementioned male part, and wherein the aforementioned blocking body is an upwardly directed blocking body.

11. The panel as in claim 1, wherein the panel has a thickness of 15 millimetres or less.

12. The panel as in claim 1, wherein the panel is substantially composed of a core material and a decorative top layer.

13. A panel which comprises coupling parts on at least two opposite sides which allow two such panels to be brought to a coupled position;

wherein these coupling parts form a horizontally active locking system and a vertically active locking system; wherein the horizontally active locking system has a male part and a female part which allow two such panels to be connected to each other on said sides by fitting one of these panels with the associated male part in the female part of the other panel by means of a downward movement;

wherein the vertically active locking system comprises a locking element which is fitted in one of the respective sides in the form of an insert;

wherein this locking element comprises at least a blocking body, a securing section and a bending zone;

wherein the aforementioned bending zone consists of an elastic bending zone which forms a connection between the securing section and the blocking body, wherein the locking element consists of a strip which is secured in a recess in the panel, wherein the locking element consists of a coextruded plastic strip which, viewed in cross section, consists of several zones made of plastic with different properties, including at least a first zone formed by the aforementioned blocking body, and, at least a second zone formed by the aforementioned bending zone;

wherein the blocking body is made of a first polymer, said first polymer is at least 60% by weight of the blocking body;

wherein the bending zone is made of a second polymer, said second polymer is at least 60% by weight of the bending zone;

wherein the blocking body is made of a mixture of the first polymer and the second polymer; or wherein the bending zone is made of a mixture of the second polymer and the first polymer;

wherein the aforementioned blocking body is a rotatable blocking body;

wherein the securing section retains the strip in the recess;

wherein the blocking body at one end forms a stop-forming locking portion which can cooperate with a locking portion of a similar coupled panel;

wherein the panel has a thickness of 15 millimetres or less;

wherein the securing section is made of the same polymer or polymer mixture as the blocking body.

14. The panel as in claim 13, wherein, in the bending zone, the percentage by weight of the first polymer in the mixture of the second polymer and the first polymer is more than 10% by weight.

15. The panel as in claim 14, wherein the first polymer is acrylonitrile butadiene styrene (ABS); or wherein the second polymer is a polyurethane or a polyurethane-based plastic, or wherein the first polymer is acrylonitrile butadiene styrene (ABS) and the second polymer is a polyurethane or a polyurethane-based plastic.

16. The panel as in claim 13, wherein, in the blocking body, the percentage by weight of the second polymer in the mixture of the first polymer and the second polymer is more than 10% by weight.

17. The panel as in claim 16, wherein the first polymer is acrylonitrile butadiene styrene (ABS); or wherein the second polymer is a polyurethane or a polyurethane-based plastic, or wherein the first polymer is acrylonitrile butadiene styrene (ABS) and the second polymer is a polyurethane or a polyurethane-based plastic.

* * * * *